United States Patent [19]

Wilson et al.

[11] 4,258,454

[45] Mar. 31, 1981

[54] APPARATUS FOR FEEDING FIBRES TO A CARDING MACHINE

[75] Inventors: Ian B. Wilson, Barwick-in-Elmet; William Oxenham, Morley, both of England

[73] Assignee: University of Leeds Industrial Services Ltd., Leeds, England

[21] Appl. No.: 83,031

[22] Filed: Oct. 9, 1979

[30] Foreign Application Priority Data

Oct. 19, 1978 [GB] United Kingdom ..... 41275/78

[51] Int. Cl.[3] ..... D01G 15/40; D01G 15/84

[52] U.S. Cl. ..... 19/105; 19/114

[58] Field of Search ..... 19/105, 114

[56] References Cited

U.S. PATENT DOCUMENTS

| | | | |
|---|---|---|---|
| 2,817,120 | 12/1957 | Scowcroft | 19/105 |
| 2,983,966 | 5/1961 | Brown et al. | 19/105 |
| 3,204,297 | 9/1965 | Wada | 19/114 |
| 3,235,910 | 2/1966 | Kalwaites | 19/105 |

FOREIGN PATENT DOCUMENTS

| | | | |
|---|---|---|---|
| 944854 | 12/1963 | United Kingdom | 19/114 |
| 1155605 | 6/1969 | United Kingdom | 19/114 |
| 1172570 | 12/1969 | United Kingdom | 19/114 |

*Primary Examiner*—Louis Rimrodt

*Attorney, Agent, or Firm*—Reising, Ethington, Barnard, Perry & Brooks

[57] ABSTRACT

Apparatus for feeding fibres, and particularly worsted fibres to a carding machine that may be a conventional worsted card or conventional cotton card. The apparatus comprises a stationary feed plate (1), a rotatable feed roller (2) and a rotatable takerin (3) for carrying fibres from the feed roller and transferring them to the surface of a carding cylinder. The surface of the takerin is furnished with pins at a pin density of not more than 36 pins per square inch (5.58 pins per square centimeter) and the distance (B) between the feed plate and the envelope of the tips of the pins on the takerin is from 0.3 to 0.75 inch (0.76 to 19.5 mm). Using this low pin density and wide spacing between the feed plate and the envelope of the pin tips effects excellent cleaning of worsted and other long staple fibre before it passes to the carding cylinder.

20 Claims, 2 Drawing Figures

APPARATUS FOR FEEDING FIBRES TO A CARDING MACHINE

Figure 1:
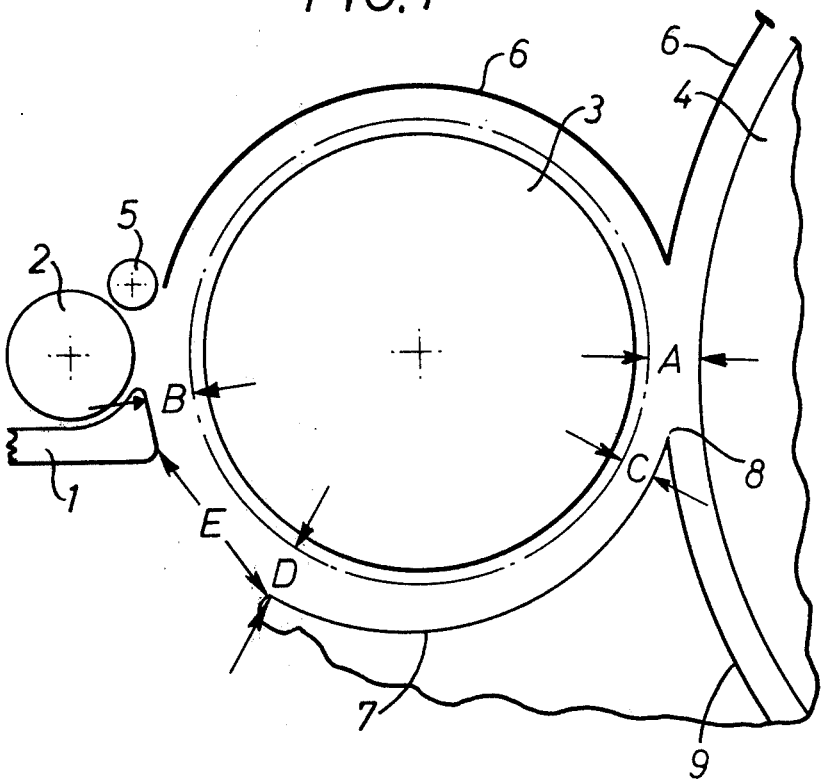

This invention relates to apparatus for feeding fibres to the carding cylinder of a carding machine, and can either be embodied in a new carding machine or fitted as a conversion to an existing carding machine. The invention also extends to a carding machine as such.

In conventional worsted carding machines the fibres are fed to the carding cylinder by way of a feed conveyor which delivers the fibres to a series of feed rollers and a takerin from whence the fibres are transferred to the carding cylinder and operated on by the usual combination of workers, strippers and fancies.

In the conventional cotton carding machine the fibres are fed over a stationary feed plate and moved from the feed plate by a rotatable feed roller from whence they are carried by a takerin to the carding cylinder and carried below the usual arrangement of movable or stationary flats. The surface speed of the takerin is greatly in excess of that of the feed roller so that the fibres are very well opened to effect a substantial degree of cleaning.

The degree of cleaning effected in the conventional feed for a worsted card is limited and there is a tendency for vegetable impurities in the wool merely to be broken down and not removed. Certain types of wool that are now becoming available have a higher content of vegetable impurities than heretofore and problems are encountered in effecting proper cleaning of this wool.

According to the present invention apparatus for feeding fibres to the carding cylinder of a carding machine comprises a stationary feed plate, a rotatable feed roller and a rotatable takerin for carrying fibres from the feed roller and transfering them to the surface of the carding cylinder, in which the surface of the takerin is furnished with pins at a pin density of not more than 36 pins per squre inch (5.58 pins per sq. cm) and the distance between the feed plate and the envelope of the tips of the pins on the takerin is from 0.03 to 0.75 inch (0.76 to 19.05 mm).

The invention also comprises a carding machine having such fibre feeding apparatus. Most surprisingly it has been found that this system effects excellent cleaning of worsted and other long staple fibre before it passes to the carding cylinder. The feed system is basically similar to that of a conventional cotton card rather than that of a conventional worsted card, but it is modified in two respects. In the conventional cotton card the takerin is usually clothed with conventional card clothing, whereas in the present invention it is essential for the takerin to be furnished with pins at the prescribed pin density. These pins should be of a form such that the takerin roller will not become loaded with fibres, and the pins are thus preferably of a relatively short and thick form rather than being long and thin. Desirably the maximum pin height is 0.125 inch (3.175 mm), and the minimum thickness of each pin at the takerin surface is 16 SWG. As stated, 36 pins per square inch is the maximum pin density on the takerin, with the more preferred range being from 20 to 30 pins per square inch (3.1 to 4.65 pins per square cm). Generally speaking the optimum number of pins per square inch reduces as the average staple length of the fibre to be treated increases.

The other way in which the apparatus differs from the conventional cotton card feed arrangement is in the setting of the feed plate relative to the surface of the takerin. In conventional cotton cards the distance between the feed plate and the envelope of the card clothing on the takerin is generally from 0.007 to 0.01 inch (0.18 to 0.25 mm), while in the present invention it is essential that the distance between the feed plate and the envelope of the tips of the pins be not less than 0.03 inch (0.76 mm). Below this setting excessive fibre breakage of the wool occurs as it is taken into the card. The maximum allowable setting is 0.75 inch (19.05 mm), and if the distance is increased beyond this limit it is found that there is considerable fibre slippage, and fibres tend to be conveyed to the carding cylinder in lumps and clumps rather than in a reasonably even distribution. The preferred setting is from 0.25 to 0.65 inch (6.35 to 16.5 mm), and generally speaking the optimum setting depends on the short fibre content of the wool and is reduced if the short fibre content is large or the average length of the fibres decreases.

There are a number of other features which need to be optimised in order to obtain best results using the apparatus of the invention. Thus, it is preferred to keep the draft between the feed roller and the takerin to the lowest figure that will still achieve satisfactory opening of the fibres. It is at present thought that the maximum allowable draft should be that resulting from a ratio of takerin surface speed to feed roller surface speed of 600:1, with a more preferred range being from 300:1 to 500:1. It is preferred to have the diameter of the takerin as large as possible and its rotational speed as small as possible while still being consistent with the degree of draft referred to above. Thus, the minimum diameter for the takerin is preferably 9 inches (22.85 cm) and diameters up to 25 inches (63.5 cm) are at present contemplated. For a 9 inch diameter takerin the preferred takerin speed is in the region of 750 rpm, which will of course be reduced as the takerin diameter is increased. The takerin and carding cylinder speeds are desirably so related that the ratio of carding cylinder surface speed to takerin surface speed is from 1.01:1 to 3:1. The spacing between the envelope of the tips of the pins on the takerin and the envelope of the card clothing or fillet wire on the carding cylinder may be in the range of 0.01 to 0.15 inch (0.25 to 3.8 mm).

Preferably an undergrid is positioned below the takerin, and the cleaning effect obtained may be assisted by preferred settings of the undergrid relative to the other elements of the apparatus. The undergrid itself may be of any known slotted or perforated type, being chosen according to the type of trash that is predominant in the fibres to be carded. The distance between the front of the undergrid and the envelope of the tips of the teeth on the takerin is preferably not more than 0.03 inch (0.76 mm) and the distance between the back of the undergrid and the envelope of the tips of the teeth on the takerin is preferably not more than 1.5 inch (38 mm). Increasing these settings from the limits shown may, in some cases, lead to greater clearance of trash from the fibre, but will also increase the short fibre wastage. Perhaps the most important undergrid setting is the distance from the feed plate to the back of the undergrid and it is presently considered that this should be approximately equal to the average staple length of the fibre being processed. Settings of from 1.5 to 5 inches (3.8 to 12.7 cm) are presently thought preferred for this distance, and generally it is desirable that it be as great as possible while still maintaining effective fibre transfer from the feed roller to the takerin. The largest possible open space between the feed plate and the undergrid facilitates the release of trash from the fibres.

One disadvantage that may have been expected from subjecting worsted fibres to a much more intensive working during their feed to the carding cylinder is that the fibres will get excessively broken, which would of course be disadvantageous. Most surprisingly, it is found that with proper settings for the apparatus effective cleaning is obtained without there being any greater fibre damage than on conventional worsted cards. Thus, a much cleaner fibre web can be taken from the carding cylinder than could be achieved with the prior art, without sacrificing any of the advantages stemming from the long staple length of the fibres.

Figure 2:
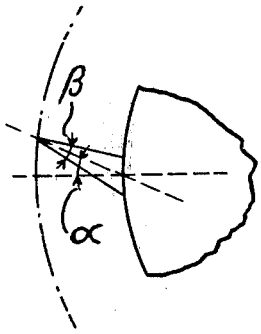

In order that the invention may be better understood reference should be made to the accompanying drawings in which FIG. 1 is a schematic view of the takerin section of a carding machine; and FIG. 2 shows a detail of the takerin roller.

As shown in the drawings the apparatus comprises a stationary feed plate 1, a rotatable feed roller 2, a rotatable takerin 3 and a carding cylinder 4. The feed roller may be a fluted roller, may be covered with card clothing or may be furnished with pins. The usual cleaning roller 5 is positioned above the feed roller, and the takerin and carding cylinder are shielded by covers 6. An undergrid 7 is mounted below the takerin with its front edge 8 adjoining an underscreen 9 surrounding the carding cylinder. No details are given of the carding elements with which the carding cylinder cooperates; these may be the usual workers, strippers and fancies with which a conventional worsted card operates or may be the movable flat bars or stationary flats with which a cotton card usually operates. It will be understood that the apparatus includes suitable drive means for the various rollers.

The surface of the takerin is furnished with pins at a pin density of not more than 36 pins per square inch (5.58 pins per square cm). The broken line in FIG. 1 shows the envelope of the tips of the pins. In one particular example the takerin comprises an aluminium outer shell in which the pins are set, the pins projecting a distance of 0.125 inch (3.175 mm) from the shell. The pins are of 16 SWG thickness and are set at an angle of 20° to the radial direction of the takerin, angle $\alpha$ as shown in FIG. 2. The tip of each pin is cut to form a tip angle $\beta$ which is from 28° to 30°, and in this example 28° 42".

The takerin that is used in the apparatus may have a diameter in the range of from 9 to 25 inches (22.85 to 63.5 cm). The angular velocity of the takerin will be related to the diameter and will usually be such that the ratio of surface speed of the carding cylinder to the surface speed of the takerin is from 1.01:1 to 3:1 and the ratio of the surface speed of the takerin to the surface speed of the feed roller is from 300:1 to 600:1. One skilled in the art can readily select suitable drive means to give the required ratios and it is deemed unnecessary to illustrate such drive means. The setting A between the envelope of the tips of the pins on the takerin and the envelope of the tips of the the card clothing or wire fillet on the carding cylinder is from 0.01 to 0.15 inch (0.25 to 3.8 mm). The setting B between the feed plate and the envelope of the tips of the pins on the takerin is from 0.03 to 0.75 inch (0.76 to 19.05 mm).

The undergrid may be perforated or slotted and will generally be mounted on the card in a manner that allows the front and back settings C and D between the undergrid and the envelope of the tips of the teeth on the takerin to be adjusted and that also allows the distance E from the feed plate to the back edge of the undergrid to be adjusted. The preferred range of settings for C and D are respectively from 0.01 to 0.03 inch (0.25 to 0.76 mm) and from 0.5 to 1.5 inch (12.7 to 38 mm). The distance E is desirably set so that it is approximately equal to the average staple length of the fibres being treated and may suitably be from 1.5 to 5 inches (3.8 to 12.7 cm).

Tests have been run with apparatus wherein the carding cylinder is of 50 inches (127 cm) diameter rotated at 310 rpm, the takerin is of 9 inches (22.86 cm) diameter rotating at 750 rpm and the feed roller is of 2.25 inches (5.72 cm) diameter.

The ratio of surface speed of the carding cylinder to the takerin is thus 2:1 and of the takerin to the feed roller is 400:1. Both slotted and perforated undergrids were used in the tests and the settings were for the front setting C 0.028 inch (0.71 mm) and for the back setting D 1.5 inch (38.1 mm). The distance E from the feed plate to the back edge of the undergrid was 3 inches (76.2 mm).

Tests were run using a lap of worsted fibres, with the setting B between the feed plate and the envelope of the tips of the pins on the takerin being varied from run to run, and also with different pin densities on the takerin. It was found that unacceptable breakage of the wool occurred if the setting B was reduced below 0.03 inch (0.76 mm) while above 0.75 inch (19.05 mm) the result was unsatisfactory as lumps and clumps of fibres were transfered onto the takerin rather than a substantially uniform web. Within the range of 0.03 to 0.75 inch (0.76 to 19.05 mm) satisfactory cleaning of the fibres was effected without unacceptable fibre breakage, and settings between 0.25 and 0.65 inch (6.35 and 16.51 mm) were found particularly suitable. Acceptable processing was achieved using pin densities of from 25 to 36 pins per square inch (3.1 to 4.65 pins per square cm) on the takerin.

It has already been stated that the feed arrangement according to the invention can be applied to either worsted or cotton type cards and enables worsted and other long staple fibres to be processed on either type of carding machine. Existing carding machines may readily be converted to incorporate the apparatus of the invention by removing the existing feed arrangement from the carding machine and replacing it by a feed arrangement according to the invention. Alternatively, new wool or cotton carding machines may be built equipped with a feed arrangement according to the invention.

Although the particular description refers to worsted or wool fibres it will be understood that other fibres may be processed by the apparatus according to the invention. Thus, not only long staple worsted fibres may be handled, but also other shorter staple wool and wool-type fibres and various types of synthetic fibres.

We claim:

1. Apparatus for feeding fibres to the carding cylinder of a carding machine, the apparatus comprising a stationary feed plate, a rotatable feed roller and a rotatable takerin for carrying fibres from the feed roller and transferring them to the surface of the carding cylinder, in which the surface of the takerin is furnished with pins at a pin density of not more than 36 pins per square inch and the distance (B) between the feed plate and the envelope of the tips of the pins on the takerin is from 0.03 to 0.75 inch.

2. Apparatus according to claim 1 in which the pin density is from 20 to 30 pins per square inch.

3. Apparatus according to claim 1 in which the maximum pin height above the surface of the takerin is 0.125 inch, and the minimum pin thickness at the takerin surface is 16 SWG.

4. Apparatus according to claim 1 in which the centreline of each pin is aligned at an angle ($\alpha$) of 20° to the radial direction of the takerin and the tip angle ($\beta$) of each pin is from 28° to 30°.

5. Apparatus according to claim 1 in which the distance between the feed plate and the envelope of the tips of the pins on the takerin is from 0.25 to 0.65 inch.

6. Apparatus according to claim 1 in which an undergrid is positioned below the takerin, the distance between the front of the undergrid and the envelope of the tips of the teeth on the takerin is not more than 0.03 inch and the distance between the back of the undergrid and the envelope of the tips of the teeth on the takerin is not more than 1.5 inch.

7. Apparatus according to claim 6 in which the distance between the front of the undergrid and the envelope of the tips of the teeth on the takerin is from 0.01 to 0.03 inch and the distance between the back of the undergrid and the envelope of the tips of the teeth on the takerin is from 0.5 to 1.5 inch.

8. Apparatus according to claim 6 in which the distance from the feed plate to the back of the undergrid is from 1.5 to 5.0 inches.

9. Apparatus according to claim 1 in which drive means are provided to drive the takerin and the feed roller at surface speeds in the range of from 300:1 to 600:1.

10. A carding machine comprising a carding cylinder, a stationary feed plate, a rotatable feed roller and a rotatable takerin for carrying fibres from the feed roller and transferring them to the surface of the carding cylinder, in which the surface of the takerin is furnished with pins at a pin density of not more than 36 pins per square inch and the distance (B) between the feed plate and the envelope of the tips of the pins on the takerin is from 0.03 to 0.75 inch.

11. A carding machine according to claim 10 in which the pin density is from 20 to 30 pins per square inch.

12. A carding machine according to claim 10 in which the maximum pin height above the surface of the takerin is 0.125 inch, and the minimum pin thickness at the takerin surface is 165 SWG.

13. A carding machine according to claim 10 in which the centreline of each pin is aligned at an angle ($\alpha$) of 20° to the radial direction of the takerin and the tip angle ($\beta$) of each pin is from 28° to 30°.

14. A carding machine according to claim 10 in which the distance between the feed plate and the envelope of the tips of the pins on the takerin is from 0.25 to 0.65 inch.

15. A carding machine according to claim 10 in which an undergrid is positioned below the takerin, the distance between the front of the undergrid and the envelope of the tips of the teeth on the takerin is not more than 0.03 inch and the distance between the back of the undergrid and the envelope of the tips of the teeth on the takerin is not more than 1.5 inch.

16. A carding machine according to claim 15 in which the distance between the front of the undergrid and the envelope of the tips of the teeth on the takerin is from 0.01 to 0.03 inch and the distance between the back of the undergrid and the envelope of the tips of the teeth on the takerin is from 0.5 to 1.5 inch.

17. A carding machine according to claim 15 in which the distance from the feed plate to the back of the undergrid is from 1.5 to 5.0 inches.

18. A carding machine according to claim 15 in which drive means are provided to drive the takerin and the feed roller at surface speeds in the range of from 300:1 to 600:1.

19. A carding machine according to claim 10 in which the takerin is located to feed fibres directly to the carding cylinder of the carding machine and the spacing between the envelope of the tips of the teeth on the takerin and the envelope of the carding cylinder is from 0.01 to 0.15 inch.

20. A carding machine according to claim 19 in which drive means are provided to drive the carding cylinder and the takerin at surface speeds in the range of from 1.01:1 to 3:1.

* * * * *